United States Patent [19]

Inman

[11] Patent Number: 4,487,140

[45] Date of Patent: Dec. 11, 1984

[54] METHOD TO REPLACE LOOPER ELEMENTS

[75] Inventor: Billy E. Inman, LaGrange, Ga.

[73] Assignee: Milliken Research Corporation, Spartanburg, S.C.

[21] Appl. No.: 577,350

[22] Filed: Feb. 6, 1984

Related U.S. Application Data

[62] Division of Ser. No. 456,628, Jan. 10, 1983, abandoned.

[51] Int. Cl.[3] ..... D05C 15/90

[52] U.S. Cl. ..... 112/79 R

[58] Field of Search ..... 112/79 R, 79 A, 79 FF

[56] References Cited

U.S. PATENT DOCUMENTS

| | | | |
|---|---|---|---|
| 4,217,837 | 8/1980 | Beasley et al. | 112/79 R |
| 4,241,675 | 12/1980 | Bardsley | 112/79 A |
| 4,303,024 | 12/1981 | Bardley | 112/79 R |
| 4,313,388 | 2/1982 | Biggs et al. | 112/79 R |
| 4,354,441 | 10/1982 | Hurst | 112/79 R |
| 4,448,137 | 5/1984 | Curtis et al. | 112/79 R |

*Primary Examiner*—Ronald Feldbaum

*Attorney, Agent, or Firm*—Earle R. Marden; H. William Petry

[57] ABSTRACT

A method to remove and replace individual loopers in a cast module encompassing a plurality of loopers. The cast module is drilled to release the individual loopers and when replaced in the module a special fastener is located in the drilled area to hold the replaced loopers in place.

8 Claims, 7 Drawing Figures

METHOD TO REPLACE LOOPER ELEMENTS

This is a division of application Ser. No. 456,628, filed Jan. 10, 1983, now abandoned.

This invention relates to a method for removing, repairing or replacing loopers for a tufting machine that are cast integrally together into a module.

In the past it has been common practice to mount loopers individually into single slots cut into looper bars on the tufting machine. An example for conventional mounting of individual loopers is shown in U.S. Pat. No. 4,003,321.

This method or general design has been used by most manufacturers of tufting equipment in the past and has proven to be satisfactory for the coarser gauge machines. As finer gauge machines were developed accurate spacing and mounting of the loopers became more critical. In mounting individual loopers into individual slots it is necessary to have some clearance between the staff of the looper and the width of the slot so as to allow the looper to be installed and removed easily. In finer gauge machines it has been found that this clearance is sufficient to allow for movement of the looper point which frequently results in malfunction of the loop forming process.

The modular concept, or the idea for mounting loopers into a single unit was brought into use on the finer gauge machines as an effort to overcome some of the inaccuracies. With the modular concept the loopers are accurately held in a fixture at the critical points and a low melting alloy is cast around the loopers, bonding them into a modular unit. These units are attached to a common carrier beneath the machine bedplate by one or more fasteners.

The modular concept has proven to be satisfactory in operation, however maintenance of the tufting machine is expensive since there is no provision for re-grinding or replacement of dull or broken loopers. Usual practice is to discard the entire module when the loopers become dull or damaged.

It is therefore an object of the invention to provide a method for re-grinding and/or replacement of loopers in a looper module to eliminate the practice of discarding a complete module upon damage to one or more loopers in the module.

Other objects and advantages of the invention will become readily apparent as the specification proceeds to describe the invention, with reference to the accompanying drawings, in which.

Figure 1:
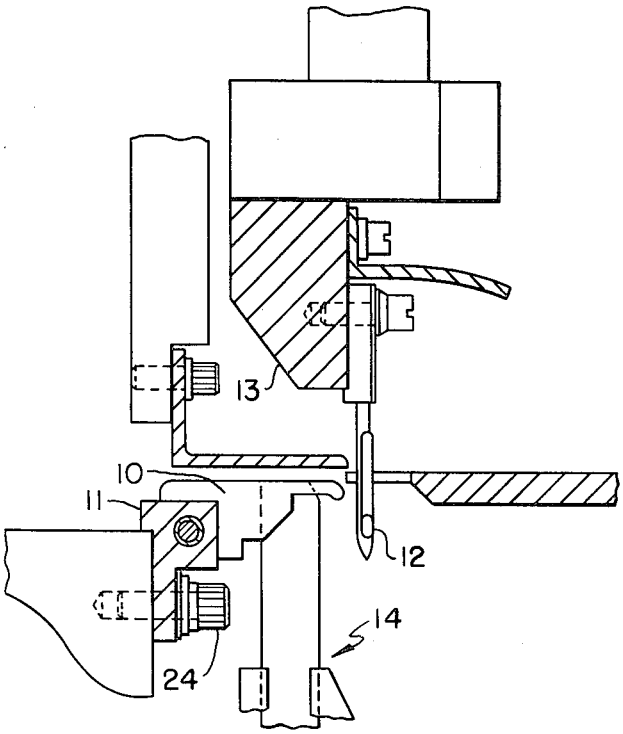
FIG. 1 is a diagrammatic side sectional view of a part of a tufting machine to which the present invention applies and for the sake of discussion illustrates only a single row of needles and cooperating loopers.
Figure 3:
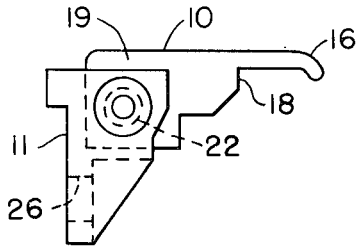
FIG. 3 is a side elevation of the looper module of FIG. 1.
Figure 4:
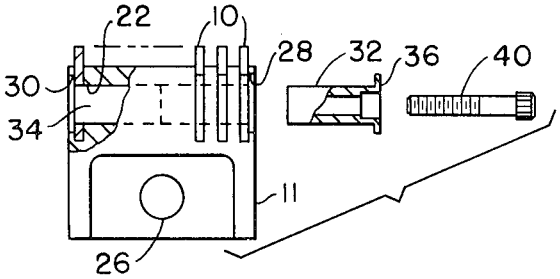
FIG. 4 is a front view of the looper module shown in FIG. 3.
Figure 5:
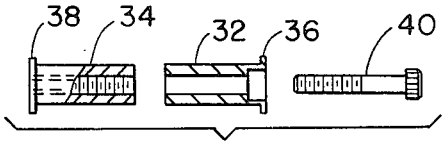
FIG. 5 is a looper securing fastener for the looper of FIGS. 3 and 4.

Referring now to the drawings, and particularly to FIG. 1 thereof, a tufting machine hook or looper 10 is supported in a looper block 11 for oscillating motion to pick up a loop of yarm from a needle 12 supported on a needle bar 13, the needle bar 13 being reciprocable in the axial direction of the needle in conventional manner. The looper 10 is co-operable with a knife mechanism 14 oscillating in timed relationship therewith for cutting the loop of yarn to form cut pile. In accordance with the invention, the loopers 10 are provided in modular units 11, such modular units being shown generally in FIG. 3 and in detail in FIG. 4.

Figure 2:
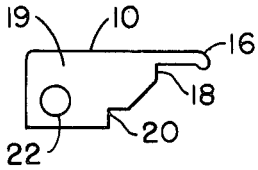
FIG. 2 is a side elevation view of a looper used in the machine of FIG. 1.

A typical looper 10 is shown in FIG. 2 and basically consists of a flat, shank portion 14 having a stepped generally rectangular configuration and a blade 16 extending forwardly from the shank in the plane thereof to define a throat 18 where the shank and blade join, the shank being further stepped at 20 rearwardly of the throat 18. Located in the shank portion 14 of each looper 10 is an opening 22 for reasons hereinafter explained.

The loopers 10 are placed in a fixture with the throats 18 in substantial alignment with one another and with the bottom yarn engaging surfaces of the blades 16 in substantial planar alignment and the body member of the module cast about the rear or mounting portion of the shanks. The hole 22 provided in each of the shanks 14 receive liquid metal during the casting process to thereby insure positive and permanent location of the looper within the body member of the module. The stepped portion 22 of the shanks aid in locating the looper and provide a large surface for the metal of the body members to hug.

When one or more of the loopers 10 in a module 11 becomes damaged or dull, the tufting machine will tend to cause flaws in the tufted fabric produced by the machine. As mentioned before, the prior practice was to unscrew the screw 24 from the openings 26 in the module 11, remove and throw away the module and replace it with a new module.

Rather than throwing away the whole module when only one or more of the loopers 10 needs repair, the module 11, after removal, is drilled throughout the length of the body member through the openings 22 to remove the metal therefrom. Once this is done individual loopers 10 can be removed from the module 11 for repair and/or regrinding. After drilling out the cast metal from the holes 22 the ends of the module are counterbored at 28 and 30 for reasons hereinafter explained.

Once the desired loopers 10 have been reground or repaired and replaced in the module 11, the flanged sleeve members 32 and 34 are inserted in each end of the module and pushed towards one another until the respective flanges 36 and 38 abut the counterbore around the drilled opening in the module. Then the screw member 40 is inserted in the sleeve 32 and screwed into the threaded interior of sleeve 34 to fasten the sleeves 32 and 34 and, consequently, the loopers 10 into a locked position.

Figure 6:
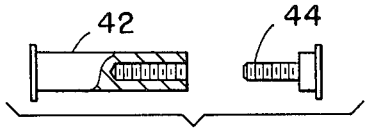
FIG. 6 is a modification of the fastener shown in FIG. 5.

Looking now at the modification of FIG. 6, the two sleeve members 32 and 34 can be replaced by one sleeve member 42 which is inserted all the way through the drilled hole in the module and a threaded cap screw 44 can be screwed into the interior of the internally threaded sleeve member 42 until the head of the cap screw abuts the counterbored portion of the drilled hole in the module.

Figure 7:
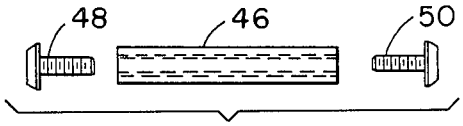
FIG. 7 is a further modification of FIG. 5.

A further modification is shown in FIG. 7 wherein, as in FIG. 6, a single sleeve member 46 is used and is drilled and tapped on each end to receive the button head screws 48 and 50. This provides a clamping action on the individual loopers 10 so that the module in effect is like the cast module of FIG. 1.

It is obvious that a method is disclosed which will allow the reuse of the looper modules of a tufting machine resulting in considerable savings since new modules will not have to be purchased as often. Furthermore, savings and efficiency can result in conversion of modules that are on hand rather than having to order new modules at an inflated price and which, due to lack of time, may reduce the number of tufting machines available for production.

Although I have described the specific embodiment of the invention, I contemplate that many changes may be made without departing from the scope or spirit of the invention, and I desire to be limied only by the scope of the claims.

I claim:

1. A looper module for a tufting machine comprising: a block member, a plurality of loopers mounted in said block member, said block member having an opening transversely therethrough, each of said loopers having an opening therein coinciding with the opening in said block member, sleeve means projecting through said opening in said block and said openings in said loopers and means retaining said sleeve means in said openings.

2. The looper module of claim 1 wherein the ends of said hole in said block members are counterbored.

3. The looper module of claim 2 wherein said sleeve means includes a pair of sleeves each with flanges on the outer ends mating with the counterbases on the ends of said openings.

4. The looper module of claim 3 wherein said retaining means is a screw member projecting through one of said sleeves and screwed into the interior of the other of said sleeves.

5. The looper of claim 2 wherein said sleeve members includes a single sleeve member projecting through said openings and having a flange member at one end mating with the counterbored on one of the ends of said hole in said body member.

6. The looper module of claim 5 wherein said retaining means is a screw member screwed into said single sleeve member and having a cap abutting the other of said counterbores in the hole in said block member.

7. The looper module of claim 1 wherein the sleeve means includes a single sleeve passing through all of the openings in said loopers.

8. The looper module of claim 7 wherein the opposite ends of said single sleeve are topped and screws are mounted in each of the tapped ends.

* * * * *

UNITED STATES PATENT AND TRADEMARK OFFICE

CERTIFICATE OF CORRECTION

PATENT NO. : 4,487,140

DATED : December 11, 1984

INVENTOR(S) : Billy Eugene Inman

It is certified that error appears in the above-identified patent and that said Letters Patent is hereby corrected as shown below:

Column 2, line 1, the word "yarm" should be --yarn--.

Column 2, line 28, the figure "22" should be --20--.

Column 3, line 16, the word "limied" should be --limited--.

Signed and Sealed this

*Thirtieth* Day of *April 1985*

[SEAL]

*Attest:*

DONALD J. QUIGG

*Attesting Officer*

*Acting Commissioner of Patents and Trademarks*